United States Patent [19]

Kilbourne

[11] 4,376,564

[45] Mar. 15, 1983

[54] LIGHTBULB LOCK

[76] Inventor: Kenneth B. Kilbourne, 1548 Lisa, P.O. Box 813, Carpinteria, Calif. 93013

[21] Appl. No.: 184,776

[22] Filed: Sep. 8, 1980

[51] Int. Cl.[3] ..... H01R 13/20

[52] U.S. Cl. ..... 339/92 R

[58] Field of Search ..... 339/69, 73, 75, 87, 339/88, 91 B, 91 L, 251, 255 R, 75 R, 75 T, 82, 83, 74 R, 92, 93

[56] References Cited

U.S. PATENT DOCUMENTS

| | | | |
|---|---|---|---|
| 702,248 | 2/1903 | Dabb et al. . | |
| 933,295 | 9/1909 | Davis . | |
| 934,760 | 9/1909 | Roy et al. . | |
| 1,148,538 | 8/1915 | Sachs | 339/87 |
| 1,187,330 | 6/1916 | Jordan | 339/87 |
| 1,259,482 | 3/1918 | Brown . | |
| 1,495,586 | 5/1924 | George | 339/87 |
| 2,494,755 | 1/1950 | Grover | 339/73 |
| 3,052,867 | 9/1962 | Rogoff | 339/255 R X |

FOREIGN PATENT DOCUMENTS

| | | | |
|---|---|---|---|
| 496059 | 10/1919 | France | 339/92 R |

*Primary Examiner*—Joseph H. McGlynn
*Attorney, Agent, or Firm*—Lyon & Lyon

[57] ABSTRACT

A device for locking lightbulbs in their sockets comprises an insert member size to project through a hole in the wall of the socket and engage the base of the lightbulb and a collar adapted to encircle the socket and press the insert into tight engagement with the base of the lightbulb.

15 Claims, 2 Drawing Figures

LIGHTBULB LOCK

BACKGROUND

Figure 1:
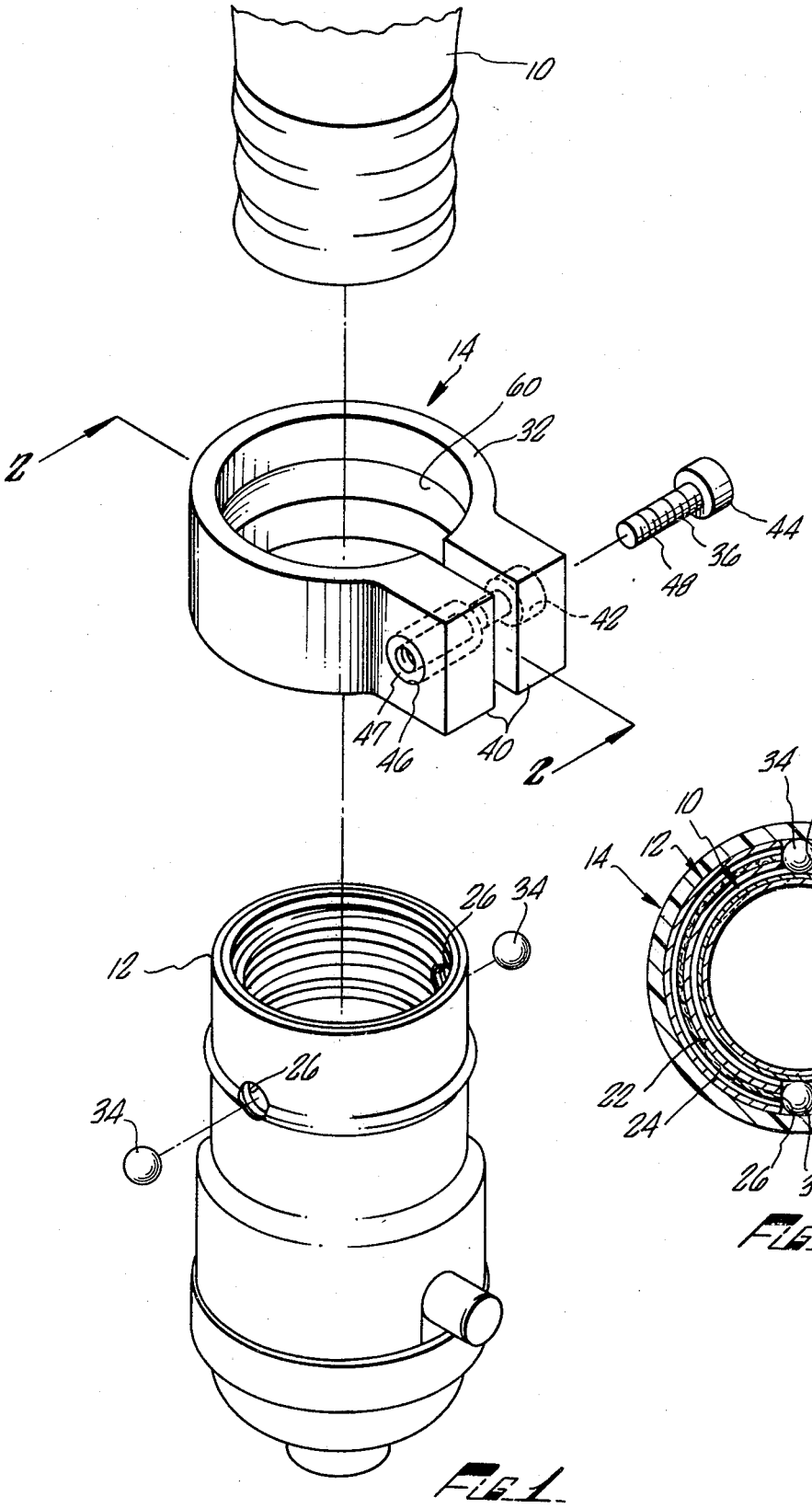

The present invention relates to a device for locking lightbulbs in their sockets.

Theft of lightbulbs has long been a problem. When lightbulbs were first introduced, due to their high cost and novelty, they were often pilfered. As a result of this, during the early 1900's, many attempts were made to develop a device for locking lightbulbs in their sockets. Exemplary of locking devices are those described in U.S. Pat. Nos. 740,248; 933,296; 934,760; 1,148,538; 1,187,330; 1,259,482; and 1,495,586.

Many of these prior art devices suffered from defects. For example, some merely relied on compression on the socket and bulb by means of a clamp. In many circumstances, the compression forces could be inadequate or could break the bulb. Another technique used was a ring around the socket with a locking screw in the ring extending through the socket and into direct engagement with the bulb as described in U.S. Pat. No. 933,296 to Davis.

After about 1920, with the advent of the mass-produced, low-priced lightbulb, interest in devices for preventing pilferage of lightbulbs decreased. However, high efficiency, long-life lightbulbs recently have been developed which are considerably more expensive than conventional incandescent lightbulbs. Among these new bulbs are fluorescent bulbs adapted to fit into a conventional incandescent holder. These new bulbs, because of their relatively high price, are the subject of theft. In view of this problem, there is a need for a locking device for the modern day lightbulb. Moreover, there is a need for a locking device that can be retrofitted to existing light sockets.

SUMMARY

The present invention is directed to such a locking device, and a method for its installation when retrofitting existing light sockets. The device can be used with a lightbulb having a standard threaded base and a corresponding threaded holder or socket.

The device comprises at least one polymeric, electrically non-conductive locking insert sized to project through a hole in the wall of the holder and engage the base of the lightbulb mounted therein. The device also comprises a polymeric, electrically non-conductive band adapted to encircle the holder over the insert. The band has an inner peripheral surface sufficiently large to completely cover the insert. Means are provided for tightening the band around the holder with the insert placed in the holder for forcing the insert into tight engagement with the base of the lightbulb to prevent removal of the bulb from the holder.

Preferably there are at least two inserts, where the two inserts are diametrically opposite each other. The insert can be a round ball, where the inner surface of the band has a circumferential groove adapted to receive the ball.

To retrofit an existing light socket, a hole sized to fit the insert is formed in the wall of the holder. The insert is placed in the hole, and the band is placed around the holder and over the insert. Once the lightbulb is placed in the holder, the band is tightened thereby forcing the insert into tight engagement with the base of the bulb.

DRAWINGS

Figure 2:
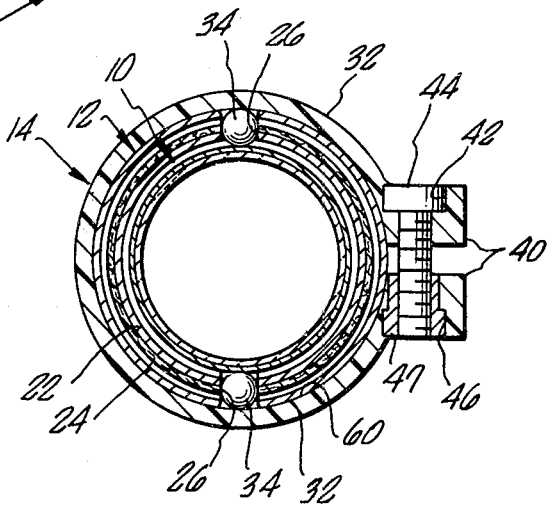

These and other features, aspects and advantages of the present invention will become better understood with reference to the following description, appended claims, and accompanying drawings where:

FIG. 1 is an exploded view of a standard lightbulb mounted in a socket with a disassembled locking device according to the present invention; and FIG. 2 is a cross-sectional view taken on line 2—2 of FIG. 1 after the locking device and the light socket have been assembled together.

DESCRIPTION

With reference to FIGS. 1 and 2, there is shown a standard lightbulb 10, a standard socket or holder 12 for the lightbulb 10, and a device 14 according to the present invention for locking the lightbulb 10 in the holder 12. The lightbulb 10 is of conventional configuration having a threaded base 14 to be screwed into the holder 12. It is to be understood that the present invention can be used with any type of lightbulb that is mounted in a conventional holder 12, including bayonet style lightbulbs.

The holder 12 is likewise of conventional configuration. It comprises an exterior housing or casing 20, and an interior threaded shell 22 with an insulating layer of paper 24 between the shell and the casing. Through the wall of the holder 12 are two diametrically opposed holes 26, whose function will be described below.

The locking device 14 comprises three elements, a tubular band or clamp 32, one or more locking inserts or members 34, and a member for tightening the band around the holder 12, such as a screw 36.

The band 32 is sufficiently large to fit around the outside of the holder 12. It has a split collar having adjacent its ends a pair of ears or lugs 40 with registering holes, a first hole 42 which is enlarged to receive the head 44 of the locking screw 36. The other hole 46 is threaded to receive the shank 48 of the locking screw. Preferably the screw 36 is an Allen head screw of uncommon or unconventional size so that it can be released only by an authorized person with a special key.

By means of the locking screw or tightening means 36, the split ends of the collar 32 can be drawn together with the desired degree of pressure for forcing the inserts 34 tightly against the base 14 of the lightbulb.

An insert 34 is mounted in each hole 26. As shown in the figures, the inserts 34 can be round balls, or alternatively a retaining pin or the like. The balls 34 are of sufficiently large diameter, generally at least about 3/16", to engage both the base 14 of the lightbulb and the clamp 32, i.e., the balls 34 extend through both the housing 20 and the shell 22 of the holder 12.

Although only one insert can be effective in locking a lightbulb in its socket, preferably at least two balls 34 are used to insure that the lightbulb cannot be unscrewed from the socket.

The insert and collar are made from polymeric, electrically non-conductive material. Because the clamp is directly in contact with the socket, which is electrically conductive and hot in use, it is imperative that the clamp be made of a non-conductive, high-heat resistant polymeric material for reliable service and long life. Also, the material used for the clamp needs to be sufficiently rigid so the clamp cannot be removed while the lamp is in the socket without destroying some or all of the assembly. The preferred material for the clamp is nylon, and the preferred nylon is nylon 101. The polymeric material can be filled with a filler such as glass fibers to improve its tensile strength.

As shown in the figures, the internal surface of the clamp 32 can be provided with a recess or groove 60 sized to accommodate the balls 34. The recess serves two functions. It insures that the balls 34 stay in place. In addition, it decreases the surface area that the clamp 32 is in contact with the socket 12, thereby resulting in an increase in pressure between the clamp 32 and the socket 12 where they are in contact with each other. This insures that the bulb cannot be pilfered from the socket.

The balls 34 can be made of the same material or a different material than is used for the clamp 32. Preferably the material used for both the insert and the clamp includes a flame retardant additive.

The locking device 14 can easily be retrofitted to existing sockets. The only modification to the socket needed is to form the holes 26 through the wall of the socket. This can be done with a simple hand punch. The balls 34 can be placed in the holes with a pair of tweezers. The balls can be placed either before or after the lightbulb 10 is threaded into the socket 12. The clamp is placed around the socket and over the balls 34, completely covering the balls. Then the locking screw 44 is tightened a sufficient amount that the insert is forced into tight engagement with the base of the lightbulb by the clamp, thereby preventing removal of the bulb from the socket. The final step is always the tightening of the clamp. The lightbulb, balls 34, and clamp 32 can be placed in position in substantially any order, except that it is impossible to place the balls 34 in location after both the clamp 32 and the lightbulb 10 are positioned.

For new light sockets 12, the clamping device of the present invention can be incorporated directly into the socket. This can be done by providing the socket with an integral clamp 32.

In another version of the present invention, sockets can be formed with easily removed plugs so that the holes 26 can be formed without the use of a hand punch.

The locking device 14 of the present invention has significant advantages. It is safe to use, since both the clamp and the balls are made of electrically non-conductive material, and the balls are completely covered by the clamp 32. Moreover, an existing light socket can easily be retrofitted. Another advantage is the use of an insert or ball 34 that is separate from the clamp. The balls 34 experience high temperatures and high stress in use of the device 14, and thus have the greatest tendency to wear out in use. Rather than having to replace the entire device, only the balls 34 ever need to be replaced.

Another advantage of having separate balls 34 is that the holes 26 through the wall of the socket can be placed anywhere. If the balls 34 were integral with the clamp 32, or the clamp 32 had special structures for accommodating the balls 34, then the holes 26 would need to be accurately located.

Although the present invention has been described in considerable detail with reference to certain preferred versions thereof, other versions are possible. For example, instead of a polymeric clamp, a metal clamp with a plastic insert between the clamp and the socket can be used. Therefore, the spirit and scope of the appended claims should not necessarily be limited to the description of the preferred versions contained herein.

What is claimed is:

1. An apparatus for locking lightbulbs in their holders and to prevent lightbulbs from being pilfered comprising:

(a) at least one polymeric, electrically non-conductive locking insert sized to project through a hole in the wall of the holder and engage the base of a lightbulb mounted therein;

(b) an electrically non-conductive band adapted to encircle the holder over the insert, the band having an inner surface engaging the holder, the inner surface being sufficiently large to completely cover the insert; and (c) means for tightening the band around the holder with the insert placed in the hole in the holder for forcing the insert into sufficiently tight engagement with the base of the lightbulb that the bulb cannot be removed from the holder without releasing the tightening means.

2. The apparatus of claim 1 comprising at least two such inserts.

3. The apparatus of claim 1 in which the band is polymeric.

4. The apparatus of claim 1 in which the insert is a ball.

5. The apparatus of claim 4 in which the inner surface of the band has a circumferential groove therein adapted to receive the ball.

6. An article for lighting comprising a lightbulb holder and a lightbulb mounted in the holder, the improvement comprising:

(a) a polymeric, electrically non-conductive locking member mounted in a hole through the wall of the holder and in locking engagement with the base of the lightbulb;

(b) an electrically non-conductive, polymeric band encircling the holder over the locking member, the band having an internal surface engaging the holder and the locking member; and (c) tightening means maintaining the band tightly around the locking member and forcing the locking member into sufficiently tight engagement with the base of the lightbulb to prevent removal of the lightbulb from the holder without releasing the tightening means.

7. The article of claim 6 comprising two locking members and two holes through the wall of the holder, each locking member being mounted in a hole and held in tight engagement with the base of the bulb by the band.

8. The article of claim 7 in which the locking members are diametrically opposite each other.

9. The article of claim 7 or 8 in which the locking members are balls.

10. The article of claim 9 in which the internal surface of the band has a circumferential groove, and the balls are mounted in the groove.

11. The article of claim 6 in which the locking member is a ball.

12. The article of claim 11 in which the internal surface of the band has a circumferential groove on its internal surface and the ball is mounted therein.

13. A method for securing a lightbulb in a holder comprising the steps of:

(a) selecting a locking apparatus comprising:

(i) at least one polymeric, electrically non-conductive locking insert sized to project through a hole in the wall of the holder and engage the base of a lightbulb mounted therein;

(ii) a polymeric, electrically non-conductive band adapted to encircle the holder over the insert, the band having an inner surface engaging the holder, the inner surface being sufficiently large to completely cover the insert; and (iii) means for tightening the band around the holder with the insert placed in the hole in the holder for forcing the insert into tight engagement with the base of the lightbulb to prevent removal of the bulb from the holder;

(b) forming a hole sized to fit the insert in the wall of the holder;

(c) placing the insert in the hole through the wall of the holder;

(d) placing the band around the holder and over the insert;

(e) placing a lightbulb in the holder; and (f) tightening the band with the tightening means a sufficient amount that the insert is forced into tight engagement with the base of the lightbulb to prevent removal of the lightbulb from the holder without releasing the tightening means.

14. The method of claim 13 in which the step of selecting a locking apparatus comprises selecting a locking apparatus having two such locking inserts, the step of forming a hole comprises forming two holes substantially diametrically opposite each other through the wall of the holder, wherein one of the locking inserts is placed in each of the holes, and the step of tightening comprises tightening the band a sufficient amount that each locking insert is forced into tight engagement with the base of the lightbulb to prevent removal of the bulb from the holder.

15. The method of claim 13 in which the internal surface of the band has a groove sized to fit the locking insert, and the step of placing the band around the holder comprises placing the band in such a position that the locking insert is in the groove.

* * * * *